United States Patent [19]

Francel et al.

[11] 4,018,717

[45] Apr. 19, 1977

[54] ARC SUPPRESSION IN A CATHODE RAY TUBE

[75] Inventors: Josef Francel, Toledo; Galen D. Lemke, Elmore, both of Ohio

[73] Assignee: Owens-Illinois, Inc., Toledo, Ohio

[22] Filed: Sept. 29, 1975

[21] Appl. No.: 617,566

[52] U.S. Cl. ..... 252/513; 252/518; 252/520; 106/1; 106/53; 106/47 R

[51] Int. Cl.[2] ..... H01B 1/08

[58] Field of Search ..... 252/513, 518 C, 520; 106/53, 47 R, 1; 313/479

[56] References Cited

UNITED STATES PATENTS

| | | | |
|---|---|---|---|
| 3,080,328 | 3/1963 | Billian | 252/513 |
| 3,355,617 | 11/1967 | Schwartz et al. | 313/82 |
| 3,669,907 | 6/1972 | Kohashi et al. | 252/518 |
| 3,758,802 | 9/1973 | Kubo et al. | 313/479 |
| 3,791,546 | 2/1974 | Maley et al. | 313/479 X |
| 3,907,585 | 9/1975 | Francel et al. | 106/53 |
| 3,954,486 | 5/1976 | Francel et al. | 106/53 |
| 3,966,449 | 6/1976 | Foster et al. | 106/53 |

*Primary Examiner*—Benjamin R. Padgett
*Assistant Examiner*—E. Suzanne Parr
*Attorney, Agent, or Firm*—Steve M. McLary; Edward J. Holler; Richard B. Dence

[57] ABSTRACT

Internal arcing in a cathode ray tube is substantially prevented by coating a portion of the interior of the funnel and neck of the tube with an electrically conductive composition, and coating a portion of the interior of the funnel and neck of the tube with an electrically resistive composition. The electrically conductive composition comprises about 10–30 weight percent iron and about 90–70 weight percent of a glass frit. The electrically resistive composition comprises about 8–24 weight percent iron, about 2–8 weight percent $TiO_2$ and about 90–68 weight percent glass frit. The use of conventional "dag" coatings is eliminated. The cathode ray tube is especially useful as a picture tube in a color television receiver in which high operating voltages are employed.

8 Claims, 1 Drawing Figure

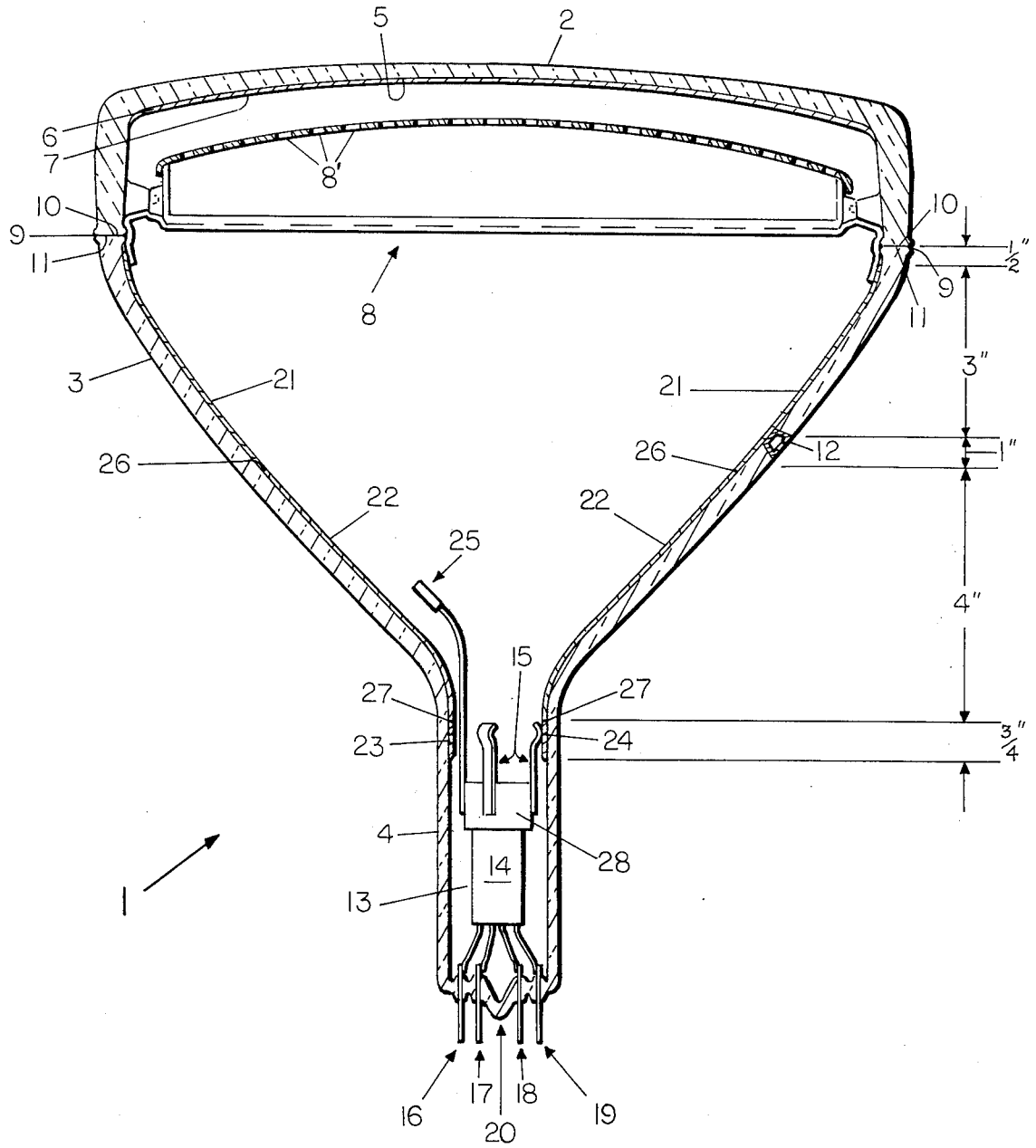
5
2
6
7
8'
10
9
11
8
10
9
11
1/2"
3"
1"
4"
3/4"
3
21
21
26
26
12
22
22
25
15
27
27
23
24
4
28
14
13
1
16
17
18
20
19

ARC SUPPRESSION IN A CATHODE RAY TUBE

BACKGROUND OF THE INVENTION

This invention relates to a cathode ray tube that is substantially arc-free during normal operation. More particularly, this invention relates to an improved cathode ray tube having an internal electrically resistive coating comprised of a glass containing iron and $TiO_2$, and an internal electrically conductive coating comprised of a glass containing iron.

A cathode ray tube is usually comprised of a funnel portion terminating at one end in a neck portion, and terminating at the other end with a faceplate portion. In the neck portion there is located a cathode comprised of an electron gun assembly. The funnel portion includes an anode, which is typically a metallic conductive anode button disposed in the wall of the funnel in the region adjacent to the area where the faceplate joins the funnel. The interior of the faceplate is coated with a fluorescent or phosphorescent material.

In cathode ray tubes used in television receivers, an aperture mask is usually interposed between the electron gun and faceplate. The aperture mask functions to produce electron beams, which activate the fluorescent and phosphorescent materials on the interior of the faceplate.

A cathode ray tube also has a conductive coating on the interior of the funnel portion and interior of the neck portion. The electrons projected by the electron gun assembly toward the interior of the faceplate are conducted away from the faceplate and other interior surfaces of the tube to the anode button by means of this conductive coating.

A product known as "Aquadag", and commonly referred to throughout the television industry as "dag", is generally used as the internal conductive coating. Dag is comprised of particulate graphite and an alkali metal silicate binder, and is usually applied in aqueous form to the interior of the funnel and neck portions of the cathode ray tube. An electrically conductive coating is formed after the dag coating is baked onto the surface at an elevated temperature.

Cathode ray tubes of the prior art are characterized by two types of internal arcing. The first type of arcing is attributable to characteristics of the dag coating. During normal tube processing and in subsequent handling, graphite particles and dag flakes are released from the dag coating. When these particles and flakes are struck by electrons from the cathode, arcing can occur within the cathode ray tube. Also, electrical leakage in the electron gun may occur. Furthermore, when the graphite particles are struck by the electrons from the gun, carbon gas may form. This results in gassing within the tube, and can also result in poisoning of barium in the electron gun. In cathode ray tubes in which a mask is interposed between the gun and faceplate, the particles and flakes can even be driven into the mask resulting in blocking of apertures in the mask. In some cases, the particles and flakes can be driven through the mask and into the fluorescent and phosphorescent materials on the faceplate. All of these phenomena shorten the life of the tube, and can adversely affect the operation of the receiver or instrument in which the tube is used.

Solutions to this problem have been proposed in U.S. Pat. No. 3,791,546 and U.S. Pat. No. 3,792,300. In each of these patents, however, dag or a modification thereof is still employed. Thus, a certain amount of flaking is to be expected.

The second type of arcing encountered in a cathode ray tube is attributable to the difference in electrical potential between the electron gun assembly and the interior surface of the neck portion of the tube in which the gun is located. It is believed that this type of arcing is dependent upon the degree of vacuum, the composition and topography of the electron gun parts and inner surface of the cathode ray tube opposite the gun, and the electric potential. This latter factor has assumed increasing importance in the color television industry where brighter pictures are being sought by increasing the operating voltage of the picture tube. This type of arcing is generally preceded by the appearance of a bluish island in the affected zone, usually between the electron gun and neck portion of the tube, and then the formation of a brilliant white flash within the tube.

This second type of arcing and solutions to it are described in greater detail in U.S. Pat. No. 3,355,617 and U.S. Pat. No. 3,758,802. U.S. Pat. No. 3,355,617 discloses a conducting coating of resistive material on the inner wall of the neck of the cathode ray tube. A highly resistant, electrically conductive film comprised of iron and manganese oxide is disposed on the walls of the neck of the tube adjacent the final anode of the electron gun assembly and coextensive therewith. A second conductive coating having less resistance than the film is joined to the film and is disposed around the neck of the tube adjacent to and coextensive with the electrodes of the gun, which are at a potential lower than the final anode. The film is electrically connected to the higher potential final anode and the coating is electrically connected to the lower potential electrodes so that the voltage drop between the film and coating and the electron gun assembly is essentially zero. The coating and film are applied in the form of water soluble salts of iron, magnesium and titanium. A baking operation is employed to drive off the water and decompose the salts to yield the oxides of the metals. This patent still discloses the use of Aquadag in the interior of the funnel portion and a forward portion of the neck of the tube. It can be expected that the internal coatings and films will be subject to flaking and peeling during assembly and subsequent processing.

U.S. Pat. No. 3,355,617 teaches that arcing between electrodes of a cathode ray tube can be minimized by providing a coating of crystallized glass on the inner surface of the neck and coextensive with the electron gun, together with a conductive material on the inner surface of the neck and spaced from the coating of crystallized glass. The patent teaches that the conductive layer can be graphite. Again, it can be expected that graphite particles will be released, thereby giving rise to the first type of arcing previously described.

In addition to being harmful to the cathode ray tube, arcing within the tube can cause severe damage to the electrical circuitry outside the tube because of the large electrical currents produced. This is particularly true when the receiver or instrument contains solid state components and devices in its circuitry. For example, the normal operating current at the anode button of a cathode ray tube in a color television receiver is about 20 – 80 milliamperes. Arcing within the tube can give rise to currents at the anode button as high as about 200 amperes. Such large currents can severly damage solid state componentry. The color television industry is now seeking to limit peak current at the anode button to about 30 amperes or less, and preferably about 10 amperes or less.

Accordingly, there exists a need in the art for a substantially arc-free cathode ray tube. The tube should be capable of being operated at high voltages without substantial internal arcing. The tube should be provided with an internal coating which is capable of serving the same function as the dag coating now used in prior art devices. The new coating should be resistant to abrasion, scratching, flaking and peeling in order to obviate the problems now encountered with dag coatings. Furthermore, the tube should be capable of being operated at test voltages of about 40,000 volts and operating voltages as high as about 35,000 volts substantially without the second type of arcing described herein. Additionally, it is essential that the tube be capable of manufacture according to the techniques commonly used in large scale manufacture of cathode ray tubes without requiring substantial changes in these techniques. The coating to be applied to the internal surfaces of the tube should be capable of being bonded to the tube during the firing cycles now employed. It is essential that the physical and electrical properties of the coating exhibit the required stability when the tube is fired and re-fired during assembly of the various components of the tube. When the cathode ray tube is employed in a color television receiver, the peak currents at the anode button should be about 30 amperes or less, preferably about 10 amperes or less, during normal operation of the receiver.

SUMMARY OF THE INVENTION

This invention aides in fulfilling these needs in the art by providing an electrically conductive composition for use on an interior surface of a funnel portion and neck of a cathode ray tube in order to substantially suppress internal arcing during operation of the tube. The electrically conductive composition consists essentially of a substantially homogeneous mixture of:

(a) about 10–30 percent by weight of iron having a particle size of about 0.1–20 microns; and (b) about 90–70 percent by weight of a lead borate or lead zinc borate glass frit having a particle size such that about 100 percent of glass frit particles pass a 100 mesh U.S. Sieve Series screen. The electrically conductive composition of this invention is capable of being fired on the funnel portion and neck of the cathode ray tube at a temperature of about 400°–450° C. to form a layer having a thickness of about 18–70 microns and an electrical resistivity of about 1 ohm to about 2,000 ohms. The electrically conductive composition is capable of substantially suppressing arcing within the cathode ray tube during operation of the tube at a voltage up to about 40,000 volts.

This invention also provides an electrically resistive composition for use on interior surfaces of a funnel portion and a neck portion of a cathode ray tube in order to substantially suppress internal arcing during operation of the tube. The electrically resistive composition consists essentially of a substantially homogeneous mixture of:

(a) about 8–24 percent by weight of iron having a particle size of about 0.1–20 microns;

(b) about 2–8 percent by weight of $TiO_2$ having a particle size of about 0.1–45 microns; and (c) about 90–68 percent by weight of lead borate or lead zinc borate glass frit having a particle size such that about 100 percent of glass frit particles pass a 100 mesh U.S. Sieve Series screen. The electrically resistive composition is capable of being fired on the funnel and neck portions at a temperature of about 400°–450° C. to form a layer having a thickness of about 18–70 microns and an electrical resistivity of about 0.5 megohm to about 80 megohms. The electrically resistive composition is capable of substantially suppressing arcing within the cathode ray tube during operation of the tube at a voltage up to about 40,000 volts.

Additionally, this invention provides an improved cathode ray tube sub-assembly comprising an open funnel portion terminating at one end in an open-elongated neck portion. An anode button is disposed in a wall of the funnel. The improvement comprises electrically conductive layers having a thickness of about 18–70 microns bonded to an interior surface of the funnel and neck. The conductive layer in the funnel contacts the anode button and covers a portion of the interior of the funnel between the anode button and the neck. The conductive layer in the neck is separated from the conductive layer in the funnel and is positioned so as to make electrical contact with an electron gun means, which forms a part of the finished cathode ray tube. The conductive layer has an electrical resistivity of about 1 ohm to about 2,000 ohms and consists essentially of about 10–30 percent by weight of iron substantially uniformly dispersed throughout a lead borate or lead zinc borate glassy matrix. An electrically resistive layer having a thickness of about 18–70 microns is interposed between the conductive layer in the funnel and the conductive layer in the neck. The resistive layer is bonded to interior surfaces of the neck and funnel and makes electrical contact with each of the conductive layers. The resistive layer has an electrical resistivity of about 0.5 megohm to about 80 megohms, and consists essentially of about 8–24 percent by weight of iron and about 2–8 percent by weight $TiO_2$ substantially uniformly dispersed throughout a lead borate or lead zinc borate glassy matrix. As used herein, the term "glassy matrix" is intended to include matrices comprised of crystallized glass, uncrystallized glass and mixtures thereof.

This invention also provides an enclosed, evacuated cathode ray tube comprising the cathode ray tube sub-assembly of this invention terminating at one end with a faceplate portion, an electron gun means positioned in the neck of the tube, and a target within the tube interposed between the gun and the faceplate, wherein the gun is capable of impinging electrons on the target.

Finally, this invention provides a method of manufacturing a cathode ray tube comprising a faceplate portion, a funnel portion and a neck portion. More particularly, this embodiment of the invention involves the new use of the compositions of this invention on the interior surfaces of a cathode ray tube. The method involves applying a fluorescent or phosphorescent material to an interior surface of the faceplate and baking the fluorescent or phosphorescent material onto the faceplate. A lead borate or lead zinc borate sealing glass frit is applied to the sealing edges of the funnel. Sealing edges of the faceplate are joined to the sealing edges of the funnel, and fired at a sufficient temperature and for a sufficient period of time to cause the sealing glass frit to seal the faceplate to the funnel. More particularly, this invention involves an improvement comprising applying an electrically conductive layer to an interior surface of the funnel prior to joining of the sealing edges. The conductive layer contacts an anode button disposed in the wall of the funnel, and covers a portion of the interior of the funnel between the anode button and the neck. A second conductive layer is applied in the neck and is separated from the conductive layer in the funnel. The second conductive layer is positioned so as to make electrical contact with electron gun means, which forms a part of the cathode ray tube. Each conductive layer consists essentially of the electrically conductive composition of this invention. An electrically resistive layer is applied to the interior surfaces of the neck and funnel prior to joining the sealing edges. The resistive layer makes electrical contact with each conductive layer, and is interposed between the conductive layer in the funnel and the conductive layer in the neck. The resistive layer consists essentially of the electrically resistive composition of this invention. The conductive layer, resistive layer and sealing glass frit are simultaneously fired in order to bond the conductive layer and resistive layer to respective surfaces of the funnel and neck while sealing the faceplate to the funnel.

BRIEF DESCRIPTION OF THE DRAWINGS

The FIGURE is a cross-sectional view of a color television picture tube containing the conductive and resistive compositions of this invention.

DETAILED DESCRIPTION OF THE INVENTION

The detailed description hereinafter relates to a cathode ray tube of the type commonly employed as a picture tube in a color television receiver. This invention is particularly advantageous in such a tube because a color television picture tube is frequently operated at the high voltages that give rise to internal arcing. It is to be understood, however, that this invention is applicable to cathode ray tubes generally, including cathode ray tubes employed as picture tubes, display tubes, oscilloscopes, camera tubes and storage tubes.

Referring to the FIGURE, a cathode ray tube generally designated as 1 is comprised of a faceplate or panel 2, a frustoconical funnel portion 3 and a neck portion 4. The interior surface 5 of faceplate 2 is coated with a layer off electron responsive phosphorescent material 6. A layer of aluminum film 7 is usually applied by vapor deposition over the layer 6 in order to conduct electrons away from the faceplate and to enhance screen imagery.

Adjacent to the faceplate and spaced apart therefrom is a grid-like member 8 having a multiplicity of openings 8' therein. This element is generally referred to in the television industry as a shadow mask or aperture mask. This element and the means for securing it in the tube are well-known in the art.

The faceplate 2 is joined to funnel 3 by means of a glass seal designated as 9. This seal is generally formed by applying a sealing glass frit to one or both of the mating surfaces 10 and 11 of the faceplate and funnel, respectively, mating the faceplate to the funnel and then firing the resulting assembly to fuse the glass frit and form a seal between the mating surfaces. The mating surfaces, of course, extend around the periphery of each of the faceplate and funnel.

Disposed in the wall of the funnel 3 is an anode button 12. This is usually a metallic, electrically conductive terminal traversing the wall of the funnel. The exterior of the anode button is adapted for electrical connection to the circuitry with which the tube is employed.

A cathode generally designated as 13 is located in the neck 4 of the tube 1. This cathode is usually an electron gun means 14 comprised of one or more electrodes (not shown). The electron gun means 14 is capable of generating electron beams, and projecting these beams toward a target comprised of shadow mask 8 and onto the layers 6 and 7 on the faceplate 2. The electron gun means is oriented in the tube by connecting means, which are shown in the FIGURE as a plurality of resilient snubbers 15. These snubbers are usually resilient fingers spaced about 120° apart. Conductive pins 16, 17, 18 and 19 further support electron gun means 14. A tubulation (not shown) is usually provided at 20 for evacuating the interior of the tube. The tubulation is subsequently sealed (as shown) after evacuation to complete the tube.

On the interior of the funnel 3 is an electrically conductive layer 21 formed from the electrically conductive composition of this invention. This layer contacts the anode button 12 and another layer 22, which is an electrically resistive layer formed from the electrically resistive composition of this invention. The electrically resistive layer 22 contacts a second electrically conductive layer 23 also formed from the electrically conductive composition of this invention. The electrically conductive layer 23 is positioned in the neck 4 in the region adjacent to and spaced from the electron gun means 14: The conductive layer 23 makes electrical contact with the electron gun means 14 at 24 via snubbers 15. The layers 21, 22 and 23 are shown as continuous bands around the interior of the tube, but other configurations can be employed.

This invention will now be described in further detail with reference to the typical procedures employed in manufacturing a cathode ray tube for a color television receiver. Before the glass faceplate of a color television tube can be sealed to the glass funnel portion, both members must first undergo a number of different processing steps.

According to current conventional practice, the faceplate and shadow mask are first mated, and then subjected to a compaction process wherein the mated parts are heated at a rate of about 10° C. per minute to a temperature of from about 440°–460° C. and held at this temperature for about 2 hours. This compaction process theoretically results in the densification of the glass, and minimizes the relative shifting which would otherwise result due to differential stress induced movements between the two components during subsequent heating and cooling steps encountered in the further fabrication and assembly of the television tube. After the components are cooled, the shadow mask is disassociated from the faceplate and marked for subsequent mating with the same glass faceplate.

The faceplate is then subjected to the separate and successive application of green, blue and red phosphors by known techniques, and, in some instances, to the application of a carbon or graphite background surrounding the phosphors and providing a sharp contrast thereto. The phosphors are present as a multiplicity of individual dots or stripes in an ordered arrangement on the inner surface of the glass faceplate. A resinous or plastic film can be applied to the surface of the phosphors. The inner surface of the faceplate is subsequently aluminized, i.e. a thin aluminum film is vapor-deposited, so that an electrically conductive surface is formed. This aluminized surface is connected to a metal stud on the inner surface of the faceplate.

During the course of phosphor application and aluminization, at least about nine different organic compounds are usually applied to the inner surface of the faceplate, in association with the phosphors, etc., and these compounds must be subsequently removed from the faceplate. Such removal is customarily accomplished by a bake-out process during which the organic compounds are volatilized or vaporized at a temperature of from about 400°–450° C. If the sealing glass frit used to seal the face panel to the funnel portion contains PbO, the bake-out step is usually performed prior to any such sealing because the organic vapors are deleterious to the PbO constituent. Specifically, the organic constitutents can chemically reduce the PbO to Pb, which can adversely affect the dielectric properties of the resulting seal. Since the high voltages present in a television tube during its operation in a television set range from about 15 K volts to about 30 K volts for a black-and-white television tube and about 20 K volts to about 35 K volts and higher for a color television tube, any dielectric breakdown in the seal between the funnel and faceplate will provide an unacceptable source of malfunction of the tube.

After the completion of the bake-out process, during which the organic vapors are volatilized or vaporized and removed, a sealing glass frit is applied to the mating edge surfaces of the funnel. The funnel and face panel are then assembled, fired in a non-reducing atmosphere at a temperature sufficiently elevated (i.e. about 420°–475° C.) to fuse the sealing glass, and then cooled, thereby resulting in the formation of a strong, adherent hermetic bond of devitrified or crystallized sealing glass between the faceplate and funnel components.

The glass parts, such as those indicated as comprising funnel, faceplate and neck, are composed of high melting glass suitable for electronic use. A typical base glass for the funnel, faceplate and neck portions is disclosed in U.S. Pat. No. 3,391,055, to Veres. Such a glass can also contain minor amounts of other oxide ingredients, such as $Fe_2O_3$, $TiO_2$ and SrO. The glass compositions and the method of making these parts are well known in the art.

The sealing glass frit employed for sealing the faceplate to the funnel is generally a PbO-containing sealing glass, and particularly a lead borate or lead zinc borate sealing glass of the type commonly used commercially to seal these components of a cathode ray tube. Such sealing glasses have the property of melting and flowing at low temperature, i.e., usually below about 500° C. and most frequently about 420°–475° C. This flowing facilitates the wetting of the glass surfaces to be sealed. A typical lead zinc borate sealing glass frit comprises the following ingredients expressed in weight percent:

| | | Usual Range |
|---|---|---|
| PbO | about | 75 – 86 |
| ZnO | about | 0 – 16 |
| $B_2O_3$ | about | 8 – 15 |
| $SiO_2$ | about | 0 – 5 |
| BaO | about | 0 – 2 |
| $SnO_2$ | about | 0 – 2 |

In lead zinc borate glasses, the ZnO in the above range is usually about 1–16 percent by weight. Other conventional glassmaking metal oxides, such as CaO, CuO, $Bi_2O_3$, $Na_2O$, $K_2O$, $Li_2O$, CdO and $Fe_2O_3$, can also be present in amounts usually less than 5 percent by weight, as long as such oxides are compatible with the glass and do not materially alter the basic characteristics of the glass or of the vitreous or devitrified seal formed therefrom. The oxide ingredients total 100 weight percent of the glass frit.

Particularly preferred lead zinc borate glass frits are comprised of the following ingredients expressed as oxide percentages by weight:

| | A | B |
|---|---|---|
| PbO | 75 | 75.5 |
| ZnO | 12.6 | 12 |
| $B_2O_3$ | 8.3 | 8.5 |
| $SiO_2$ | 2.1 | 2 |
| BaO | 2 | 2 |
| Fiber softening point - ° C. | 375°±5° | 370°±5° |
| Thermal coefficient of expansion - cm/cm/° C. | 96 | 95 |

These two frits can be fired at a peak temperature of about 40° C. '475° C. for about 1 hour with a heat-up rate of about 10° C. per minute and a cool-down rate of about 6° C. per minute. A crystallized glass is formed after this firing cycle.

The compaction process previously described is required when the color television tube is subjected to processing temperatures of about 440° C. or higher. These temperatures are usually encountered during the frit sealing of the faceplate to the funnel portion of the tube. In some cases, it may be possible to eliminate the compaction process by frit sealing the faceplate to the funnel portion at temperatures of about 400°–415° C. or lower. A suitable sealing glass frit for this purpose and the processing procedures are described in U.S. Pat. No. 3,954,486, dated May 4, 1976, and commonly assigned, copending U.S. patent application Ser. No. 592,968, filed July 3, 1975, and entitled SEALING GLASS COMPOSITION AND PASTES AND USE THEREOF. The entire disclosure of each of these documents is relied upon and incorporated herein by reference.

U.S. patent application Ser. No. 592,968, filed July 3, 1975 describes a particularly preferred glass frit which can be fired at a temperature of about 400° C. to about 415° C. and comprises the following oxide ingredients expressed in weight percent:

| | C |
|---|---|
| PbO | 84.0 |
| $B_2O_3$ | 12.3 |
| ZnO | 2.7 |
| $SiO_2$ | 0.4 |
| BaO | 0.6 |

This frit is mixed to form a blend with a particulate refractory filler having a particle size diameter in excess of about 37 microns to lower the expansion of the glass while maintaining adequate glass flow during fusion. Typical particulate, low expansion refractory fillers are silica, lithium aluminosilicates, including betaspodumene, petalite, and low expansion lithium aluminosilicate glass-ceramics; alumina, aluminosilicates; zirconia; titania; tin oxide; and zircon. The particulate refractory filler is present in an amount of about 1 to about 25% by weight of the blend, preferably about 5 to about 20% by weight of the blend. This blend of lead zinc borate glass and particulate refractory filler, as well as similar blends, are disclosed in greater detail in said U.S. Pat. No. 3,954,486.

A typical firing cycle for glass C comprises firing the frit at a peak temperature of about 400°–415° C. for about 25–40 minutes with a heat-up period of about 5°–15° C. per minute and a cool-down rate of less than 8° C. per minute, thereby resulting in the formation of a substantially vitreous glass having a small number of crystallites therein. The heat-up rate depends upon the thickness of the substrate to which the frit is being bonded. The lower heat-up rates are employed with thicker substrates.

The sealing glass frit can be prepared according to conventional techniques. Typically, this involves preparing a mixture of the required oxide ingredients, melting the ingredients in a conventional furnace at an elevated temperature, such as about 1700° to about 2300° F. for a period of about 20 minutes to about 40 minutes. The melted glass is then cooled and formed into chips, after which it can be ground into a frit of the desired particle size. This grinding operation usually takes place in a ball mill. After grinding in the ball mill, the resulting product is screened through a 100 mesh screen. The material passing through this screen is collected and employed as the sealing glass frit.

In a preferred embodiment of this invention, the sealing of the faceplate to the funnel is carried out simultaneously with the bake-out and removal of organic compounds from the faceplate. In order to combine these steps, it is necessary to prevent the chemical reduction of the PbO constitutent in the sealing glass frit to metallic lead. U.S. Pat. No. 3,973,975, dated Aug. 10, 1976, discloses a means for accomplishing the combination of these processing steps. The entire disclosure of this patent is relied upon and incorporated herein by reference. This patent discloses the use of additives, such as $Pb_3O_4$, $BaO_2$ and $Bi(NO_3)_3.5H_2O$, which are added in particulate form to the sealing glass frit, and which can be used in an amount sufficient to prevent the PbO from being chemically reduced when the glass frit is being fired in the presence of reducing conditions at a temperature sufficient to seal the glass. It is disclosed that the additive is compatible with the base glass in that the additive does not produce a substantial adverse effect upon the properties of the base glass after it has been fired.

After the faceplate has been sealed to the funnel portion of the tube, a small portion of the neck portion of the funnel, which had been provided for ease for handling of the funnel, is removed. The electron gun sub-assembly is then sealed to the remaining portion of the neck of the funnel to thereby form the neck of the tube. The interior confines of the tube are evacuated by applying a vacuum thereto. While being evacuated, the tube must be heated to a temperature within the range of about 340°–410° C. in order to assure that all volatile, deleterious substances, such as moisture and organic materials, are liberated and withdrawn from interior surfaces and confines of the tube. The tube is then closed by sealing the tubulation mentioned in connection with the FIGURE.

During the assembly of the tube, a gettering material can be provided within the tube. A typical getter is shown as 25 in the FIGURE. The getter is employed to take up and remove undesirable gas ions in the tube by absorbing or forming compounds with the gases, the resulting compounds being stable at the high operating temperatures of the tube. Common getter materials are the alkaline earth metals, such as barium, strontium, calcium and beryllium. Frequently, a reducing agent is mixed with a compound of one or more of these alkaline earth metals and the mixture is heated causing a chemical reaction which releases the metal from the compound. Reducing agents such as molybdenum, tungsten, columbian, titanium, tantalum and zirconium or compounds of these reducing agents are often employed in the mixture with the compound of alkaline earth metals. The reducing agents form stable compounds at high temperature, thereby releasing the alkaline earth metal in pure form. The gettering materials are activated by heating the getter to a temperature of about 400° C. or higher. This can be accomplished by induction heating without substantially increasing the temperature of the other tube components.

Ordinarily, a coating of dag would be applied to the interior surfaces of the funnel and neck portions of the color television tube before the faceplate is sealed to the funnel. The dag coating is ordinarily cured onto the tube surfaces before the frit sealing of the faceplate to the funnel. In the present invention, the dag coating is eliminated. This invention provides an electrically conductive composition and an electrically resistive composition for use on the internal surfaces of the funnel and neck portions of the cathode ray tube. The electrically conductive composition and electrically resistive composition of this invention can be fired at an elevated temperature to form a hard glass layer having iron particles and $TiO_2$ particles substantially uniformly dispersed therethrough. The resulting layers are very hard, durable, scratch resistant, and form a tenacious bond with the funnel and neck portions after firing.

The electrically conductive composition of this invention consists essentially of iron in particulate form and a glass frit. The iron has a particle size of about 0.1 to about 20 microns, preferably about 0.1 to about 10 microns. A particularly preferred particulate iron is available under the trade name K-291 from Glidden Metals (SCM Corporation) Cleveland, Ohio 44115. Glidden K-291 has the following particle size:

| Microns | Weight % |
|---|---|
| 0 to 5 | 68.1 |
| 5 to 10 | 30.6 |
| over 10 | 1.3 |

The glass frit is a lead borate or lead zinc borate glass frit. It will readily be appreciated that the electrically conductive composition and the sealing glass frit used to seal the faceplate to the funnel should be selected so that the glass frits in the respective compositions can be co-fired (i.e. fired under the same conditions of time and temperature to fuse the glass and form a hard, glassy matrix). For this reason, the glass frit employed in the electrically conductive composition will usually be the same as the sealing glass frit employed in sealing the faceplate to the funnel. Thus, in preferred embodiments of this invention, the glass frits employed in the electrically conductive composition will be selected from frits A and B previously described. These glass frits are preferred because they match the thermal coefficient of expansion of the preferred hard glass generally employed in the funnel, faceplate and neck, and because these frits can be fired at a temperature of about 420°–475° C. to form a substantially devitrified glass material.

Glass frit C is a particularly glass frit which can be fired at a temperature of about 400° to about 415° C. as previously described.

The particle size of the glass frit employed in the electrically conductive composition of this invention is such that about 100% of the particles pass a 100 mesh U.S. Sieve Series screen, and preferably about 67 ±5% of these particles pass a 400 mesh U.S. Sieve Series screen. Thus, substantially all of the frit particles will have an average particle diameter of about 149 microns or less, which corresponds to the size of particles passing a 100 U.S. Sieve Series screen. In like manner, preferably about 67 ± 5% of the frit particles will have an average particle diameter of 37 microns or less.

In the electrically conductive composition of this invention, the iron comprises about 10–30 percent by weight, preferably about 20–25 percent by weight of the composition. The glass frit comprises about 90–70 percent by weight, preferably about 80–75 percent by weight of the composition. If the amount of iron exceeds about 30 weight percent, the composition does not possess the proper hardness after firing. On the other hand, if the iron is less than about 10 percent by weight, the composition does not possess the proper resistivity after firing. In the particularly preferred embodiment of this invention, the iron comprises about 21 percent by weight and the glass frit about 79 percent by weight of the electrically conductive composition. In order to insure that the electrically conductive layer in the neck has sufficient hardness, the quantity of iron in this layer will preferably not exceed about 25 weight percent. This will minimize the liklihood of particles being dislodged from the electrically conductive layer by the snubbers on the electron gun means. For purposes of convenience and economics, the electrically conductive composition employed on the funnel will generally be the same as the electrically conductive composition employed in the neck.

The electrically conductive composition of this invention is prepared by blending the iron particles and glass particles in suitable mixing equipment, such as a ball mill, V-blender, paint shaker, etc. It is also possible to employ relatively large glass chips, mix these chips with the iron particles, and then simultaneously crush the chips to form the glass frit while blending the resulting frit with the iron particles.

The electrically conductive composition of this invention is applied to the inner surface of the funnel portion of the cathode ray tube. This is conveniently accomplished by applying the composition in paste form. A suitable paste can be prepared by mixing the electrically conductive composition with a vehicle comprised of an organic binder and a solvent for the binder. The vehicle should be substantially sulfur and fluorine free, since sulfur attacks metal components in the tube, while fluorine attacks glass and barium components.

The binder can be any organic or inorganic, pyrolyzable binder capable of imparting green strength to the electrically conductive composition before it is fired. Methacrylate and stearate binders are to be avoided because of their detrimental effect on the tube during subsequent processing. Preferably, the binder is water soluble.

The solvent employed in the vehicle will depend upon the nature of the binder. The solvent must be a solvent for the binder. Preferably, a water-soluble binder is employed and water is employed as the solvent for safety and health reasons in large scale commercial operations. Organic solvents can also be employed.

The vehicle is generally comprised of about 1-4 weight percent binder and about 99–96 weight percent solvent. The vehicle comprised of the binder and solvent is then mixed with the electrically conductive composition to form a paste comprising about 75–85 percent by weight, preferably about 80 percent by weight, of the electrically conductive composition in the paste.

The resulting paste can then be conveniently applied to the internal surfaces of the funnel and neck portions of the tube by means of a brush, cloth, or cotton swab. In large scale operations, spraying of the paste onto the inner surface of the funnel and neck will generally be employed. One or more coats can be applied so that the thickness of each conductive layer after firing is about 18–70 microns, preferably about 30–70 microns, especially about 45–55 microns.

In the preferred embodiments of this invention, a paste suitable for spraying comprises about 70 weight percent solids and about 30 weight percent of a vehicle comprising a solution of about 4 percent by weight hydroxypropyl cellulose in about 96 percent by weight water. A preferred paste suitable for brushing comprises about 80 percent by weight solids and about 20 percent by weight of the same vehicle. If the particle size of the solids is near the lower end of the previously mentioned ranges, the vehicle can be reduced to about 15 percent by weight and the solids increased to about 85 percent by weight in the paste to be suitable for brushing. Pastes containing smaller sized particles exhibit more cohesion, and therefore, a smaller amount of the vehicle is required in order to obtain the required green strength. The particularly preferred hydroxypropyl cellulose is Klucel EF which is available from the Hercules Company, Wilmington, Delaware.

In the particularly preferred embodiment of this invention, the electrically conductive layer 21 is applied to within about ½ inch from the mating edge 11 of the funnel to about one inch beyond the anode button toward the neck of the funnel. This is shown in the FIGURE. The electrically conductive layer in the neck is preferably about ¾ inch width, as shown in the FIGURE, and is positioned so as to contact the snubbers on electron gun means. After the electrically conductive compositions are applied to the interior surfaces of the funnel and neck, they are dried and subjected to the firing cycle for the glass frit. After firing, the electrically conductive layers each have an electrical resistivity of about 1 ohm to about 2000 ohms, about 50–2000 ohms, especially about 250 ohms to about 1000 ohms. The resulting layers exhibit excellent adhesion and high hardness. The adhesion and hardness of these layers are substantially superior to the adhesion and hardness when dag is employed.

This invention also provides an electrically resistive composition for use on the interior surface of the funnel and neck portion of the cathode ray tube. The electrically resistive composition is used in combination with the electrically conductive composition of this invention. These compositions are capable of substantially suppressing arcing within cathode ray tubes during normal operation of the tubes and at operating voltages as high as about 35,000 volts and test voltages as high as about 40,000 volts.

The electrically resistive composition of this invention consists essentially of a substantially homogeneous mixture of particulate iron, particulate $TiO_2$ and a glass frit. The iron particles and glass frit employed in the electrically resistive composition have the same requirements as the corresponding ingredients in the electrically conductive composition of this invention. Preferably, the iron employed in the electrically resistive composition is the same as the iron employed in the electrically conductive composition. It is also preferred that the glass frit employed in the electrically resistive composition is the same as the glass frit employed in the electrically conductive composition, which in turn is the same as the glass frit employed in sealing the faceplate to the funnel.

The electrically resistive composition also includes $TiO_2$. The titanium dioxide is preferably of a grade that is substantially free of impurities that substantially affect the resistivity of the electrically resistive composition. Certified grade titanium dioxide is preferred, since it meets these requirements. While technical grades of titanium dioxide can also be employed, it has been discovered that the resistivity of the electrically resistive composition is usually lowered because of the presence of electrically conductive impurities. Accordingly, the amount of technical grade titanium dioxide will usually be less than the amount of certified grade titanium dioxide for electrically resistive compositions having the same resistivity.

The amount of iron in the electrically resistive composition is about 8–24 percent by weight, preferably about 16–18 percent by weight. The optimum amount of iron is about 16 percent by weight of the electrically resistive composition. If the amount of iron exceeds about 24 weight percent, adequate hardness of the fired composition is not obtained. Amounts less than about 8 weight percent do not give the proper resistivity in the finished tube.

The $TiO_2$ in the electrically resistive composition is about 2–8 percent by weight, preferably about 5–6 percent by weight. The optimum proportion is about 6 percent by weight of the electrically resistive composition. The amount of $TiO_2$ is varied in the same direction as the amount of iron. Thus, for example, if the amount of iron is near the lower end of the range of 8–24 weight percent, then the amount of $TiO_2$ will be near the lower end of the range of 2–8 weight percent. Similarly, a large amount of $TiO_2$ will be employed when a large amount of iron is employed.

The glass frit in the electrically resistive composition comprises about 90–68 weight percent, preferably about 79–76 weight percent of the electrically resistive composition. The optimum proportion is about 78 percent by weight glass frit based on the weight of the electrically resistive composition.

The electrically resistive composition can be formed into a paste as described in connection with the electrically conductive composition. This paste can be applied to the interior of the funnel and neck portions of the tube, such as by brushing, spraying or swabbing as previously described, dried and then fired to fuse the glass. The resulting fired layer has a film thickness of about 18–70 microns, preferably about 30–70 microns, especially about 45–55 microns. It has a resistivity of about 0.5 megohm to about 80 megohms, preferably about 1–20 megohms, especially about 1 megohm to about 10 megohms. The electrically resistive composition contacts the electrically conductive compositions as shown at 26 and 27 in the FIGURE. It is important that corresponding adjacent edges of the conductive and resistive layers be in contact over their entire peripheral edges in order to avoid the presence of discontinuities in adjacent edges. Such gaps can result in the formation of small electrical arcs across the gaps. Thus, the electrically conductive and electrically resistive compositions can be overlapped at 26 and 27 in order to assure electrical continuity. A typical overlap is about ⅛ inch.

In the preferred embodiment of this invention, the electrically resistive composition is applied about ½ inch into the neck and about 3 ½ inches into the funnel. Thus, the overall dimension for the resistive layer is about 4 inches as shown in the FIGURE.

The dimensions shown in the FIGURE relate to a 19 V 90° tube, that is, a cathode ray tube having a diagonal measurement at the faceplate of about 19 inches, wherein the sidewalls of the funnel together form an angle of about 90°. It will be understood that optimum dimensions for tubes having a different size can be determined with a minimum of experimentation.

The electrically conductive and electrically resistive compositions are applied to the funnel and neck portions before the sealing glass frit is applied to the sealing edge of the funnel. In the preferred embodiment of this invention, it is possible to co-fire the faceplate with the funnel and the electrically conductive and resistive compositions in a sealing lehr. This is made possible by using the same glass frit in the electrically conductive composition, the electrically resistive composition and the sealing glass employed to seal the faceplate to the funnel. This is particularly advantageous because of the economies that can be realized in commercial operation. The drying and firing steps required when dag is used as an internal coating can be eliminated by employing the compositions and methods of the present invention. Significant savings in energy and manufacturing costs are to be expected.

This co-firing operation can be conducted in air by following the teachings in the aforementioned U.S. Pat. No. 3,973,975. As previously described, the tube is evacuated by heating it to an elevated temperature while applying a vacuum to the interior thereof. The atmosphere surrounding the electrically conductive composition and electrically resistive composition during this evacuation step is substantially free of oxygen. It has been observed that compositions comprised of ingredients and/or having proportions different from those described herein drastically change in resistivity during this evacuation step. In many cases, the resistivity prior to evacuation and after evacuation decreases about 1 to about 300 fold. Furthermore, the changes in resistivity are not predictable or reproducible. It has been discovered that the electrically conductive composition and electrically resistive composition having the ingredients in the proportions described herein can be subjected to an evacuation step without substantial changes in resistivities. Thus, if the change in resistivity during the evacuation step is to be minimized and if predictable and reproducible resistivities are to be obtained, it is essential that the electrically conductive composition and the electrically resistive composition be comprised of the ingredients described herein and contain these ingredients in the proportions described herein.

It will be understood that the glass frits employed in this invention will depend upon the properties of the substrate to which they are to be bonded. Generally, the thermal coefficient of expansion of the glass frit after it is fired will be matched as closely as possible to the thermal coefficient of expansion of the substrate.

This invention will be further described in the following examples in which all parts, proportions, percentages and ratios are by weight, unless otherwise indicated.

EXAMPLE I

PART A Preparation of Resistor Pastes

Three vehicles for use in pastes were prepared by mixing binders with deionized water to form aqueous solutions containing 4 weight percent binder. The resulting three vehicles are identified as follows:

| Vehicle Designation | Binder | Viscosity at 23° C. |
|---|---|---|
| V-1 | KLUCEL EF | 40 cps |
| V-2 | KLUCEL G | 1540 cps |
| V-3 | METHOCEL 90HG | 748 cps |

KLUCEL is a nonionic water-soluble hydroxypropyl cellulose ether available from Hercules, Wilmington, Delaware. METHOCEL is a water-soluble hydroxypropyl cellulose available from The Dow Chemical Co., Midland, Mich. 48640.

Solids components are then prepared by blending a glass and iron powder in the following proportions:

| Designation of Mixture | Glass Parts by Weight | Iron Parts by Weight |
|---|---|---|
| S-1 | 2 | 1 |
| S-2 | 3 | 1 |
| S-3 | 4 | 1 |

The glass employed was Glass A, previously described. The iron was Fe 187 from Atlantic Equipment Engineering, 181 Reid Avenue, Bergenfield, N.J. 07621. This iron has a particle size of 1–5 microns.

The following resistor coating pastes were then prepared by mixing the vehicles with the various solids components to yield pastes containing 80 weight percent solids component and 20 weight percent vehicle.

| Paste Designation | Vehicle | Solids Component |
|---|---|---|
| R-1 | V-2 | S-1 |
| R-2 | V-2 | S-2 |
| R-3 | V-2 | S-3 |
| R-4 | V-3 | S-1 |
| R-5 | V-3 | S-2 |
| R-6 | V-3 | S-3 |
| R-7 | V-1 | S-1 |
| R-8 | V-1 | S-2 |
| R-9 | V-1 | S-3 |

Another vehicle designated V-4 is prepared, and comprises 7.5 weight percent ethyl cellulose (N-50 from Hercules, Wilmington, Del.) in a solution containing cellosolve acetate (ethylene glycol monoethyl ether acetate) and Terpineol 214 in a 1:1 weight ratio. Terpineol 214 is a trade name for $C_{10}H_{18}O$ and is available from Crosby Chemical, Inc., Picayune, Miss.

The following pastes containing 80% solids and 20% vehicle are prepared:

| Paste Designation | Vehicle | Solids Component |
|---|---|---|
| R-10 | V-4 | S-1 |
| R-11 | V-4 | S-2 |
| R-12 | V-4 | S-3 |

PART B Firing in Air

A faceplate of the type generally employed in a color television cathode ray tube is cut into 1½ × 1½ inches glass panels. The following resistor coating pastes are then swabbed onto the glass panels to form a 1 × 1 inch square centered on each panel. A ¼ × 1½ inch bus bar is provided along one side of the square and in contact therewith. A second bus bar of the same dimensions is provided on the other side of the square and parallel to the first bus bar. The panels are fired in a furnace at 450° C. for 1 hour in an air atmosphere, with a heat-up rate of 13° C. per minute. The squares are then cooled, removed from the furnace and the resistance between bus bars is measured. The following results are obtained:

| Fired Paste | Resistivity* Ohms |
|---|---|
| R-1 | 1.3K – 3.3K |
| R-2 | 1.8K – 17.2K |
| R-3 | 5.0K – 6.8K |
| R-4 | 2.9K – 6.1K |
| R-5 | 14.7K – 15.4K |
| R-6 | 9 meg – >15 meg |
| R-10 | 0.8K – 0.9K |
| R-11 | 1.6K – 2.4K |
| R-12 | 0.5 meg – 14.7 meg |

*Expressed as a range of values obtained by firing several samples.

Instead of swabbing glass squares, the following resistor coating pastes are sprayed onto the squares, bus bars are provided as above, and each panel is fired and the resistor measured.

| Fired Paste | Resistivity Ohms |
|---|---|
| R-7 | 5.5K – 6.8K |
| R-8 | 52K – 450K |
| R-9 | >15 meg |

These data demonstrate that it is important to control the amount of iron in the resistor composition if the proper resistance is to be obtained.

In each of the above-mentioned panels, the average thickness of the squares and bus bars was 45–55 microns after firing. The bus bars were applied in the form of Electronic Grade 7941 Silver containing an epoxy binder in butyl cellosolve acetate. This product is available from E.I. du Pont de Nemorus and Co., Electrochemicals Department, Wilmington, Del.

Firing the resistor coating paste in an air atmosphere simulates the frit sealing environment during which the faceplate is sealed to the funnel of a color television tube. Such a tube must then be subjected to the evacuation and tip-off operation during which the tube is again heated and a vacuum applied to the interior. This is simulated in the laboratory by re-firing the glass panels in a nitrogen atmosphere.

PART C Firing in Nitrogen Atmosphere

Each of the previously fired glass panels is re-fired in a furnace at 450° C for 1 hour in a nitrogen atmosphere with a heat-up rate of 13° C. per minute. The squares are cooled to room temperature, removed from the furnace and the resistance measured.

| Re-Fired Paste | Resistivity Ohms |
|---|---|
| R-1 | 0.8K – 1.5K |
| R-2 | 1.0K – 10K |
| R-3 | 2.3K – 2.7K |
| R-4 | 0.8K |
| R-5 | 1.1K – 1.4K |
| R-6 | 17K – 40K |
| R-7 | 2.5K – 3K |
| R-8 | 30K – 368K |
| R-10 | 0.4K – 0.45K |
| R-11 | 0.5K – 0.75K |
| R-12 | 50K – 70K |

These data demonstrate the criticality of the resistor composition. Whereas R-6 and R-12 exhibited the proper resistivity when fired in air, the resistivity dropped so drastically after re-firing the samples in nitrogen that even these compositions are unusable in TV applications. In every case, the resistivity was too low as a resistive coating for TV application.

EXAMPLE 2

This Example demonstrates that it is possible to retard the drop in the resistivity of a resistor coating paste when it is re-fired in a nitrogen atmosphere by replacing a portion of the iron with $TiO_2$.

A resistor coating paste is prepared by ball milling a solids component comprised of:

| | Weight % |
|---|---|
| Glass A | 78 |
| Iron | 16 |
| $TiO_2$ - Certified grade | 6 |

with vehicle V-1 as described in Example 1. The iron was K-291 available from Glidden, (SCM Corp.), Baltimore, Md. 21226. 99.99% of the $TiO_2$ had a particle size less than 45 microns. The ingredients were charged into the mill in a ratio of 70 weight percent solids to 30 weight percent vehicle, and milled for 18 hours.

Following a procedure analogous to Example 1, the resistor coating paste was sprayed onto 1½ × 1½ inch glass panels cut from the funnel portion of a TV tube. The squares were then fired at different temperatures in air and nitrogen. The following resistivity values between bus bars were obtained.

| Sample No. | Air Atmosphere 435° C. 60 min. | Air Atmosphere 440° C. 60 min. | Air Atmosphere 445° C. 60 min. | $N_2$ Atmosphere 425° C. 60 min. |
|---|---|---|---|---|
| 1 | 80 meg | | | 40 meg |
| 2 | 30 meg | | | 15 meg |
| 3 | | 1.6 meg | | 1.2 meg |
| 4 | | 1.0 meg | | 800 K |
| 5 | | | 1.0 meg | 700 K |
| 6 | | | 2.0 meg | 1.6 meg |

These data demonstrate that $TiO_2$ not only stabilizes resistivity when re-firing in nitrogen, but also that the firing temperature in air affects the resistivity. Increasing the firing temperature in air may reduce the resistivity.

EXAMPLE 3

Various resistor coating pastes are prepared by the procedure described in Example 2. The proportions of the ingredients were varied as shown below. The vehicle employed in each case was comprised of 4 weight percent KLUCEL EF in deionized water. Each of the pastes was comprised of 70 weight percent solids and 30 weight percent vehicle. Resistance is measured between bus bars. In each instance, the average thickness of the fired square and bus bars was 45–55 microns.

TABLE

| Paste Designation | Glass | Wt.% Glass | Metal[3] | Wt.% Metal | Oxide[3] | Wt.% Oxide | Resistivity - Ohms Air 450° C 1 Hr. | Resistivity - Ohms $N_2$ 450° 1 Hr. | Resistivity - Ohms $N_2$ 450° 1 Hr. |
|---|---|---|---|---|---|---|---|---|---|
| R-13 | A | 100 | | | | | Infinite | Infinite | |
| R-14 | A | 66.7 | Fe | 33.3 | | | 200 | | |
| R-15 | A | 50 | Fe | 50 | | | 750 | | |
| R-16 | A | 86 | Fe | 8 | $TiO_2$ | 6 | 2000 meg | Infinite | |
| R-17 | A | 84 | Fe | 10 | $TiO_2$ | 6 | 500 meg | 390 meg | 235 meg |
| R-18 | A | 82 | Fe | 12 | $TiO_2$ | 6 | 28.5 meg | | |
| R-19 | A | 88 | Fe | 12 | | | 24.5K | | |
| R-20 | A | 85 | Fe | 15 | | | 4.8K | | |
| R-21 | A | 80 | Fe | 20 | | | 475 | | |
| R-22 | A | 77 | Fe | 20 | $TiO_2$ | 3 | 1.9K | | |
| R-23 | A | 82 | Fe | 12 | $TiO_2$[1] | 6 | 338K | 43K | 20.5K |
| R-24[2] | A | 82 | Fe | 12 | $TiO_2$ | 6 | Infinite | Infinite | Infinite |

Notes:
[1]Technical grade $TiO_2$ used in R-23. Certified grade used in all other pastes in Table.
[2]Ingredients melted together and then ground.
[3]Same as that described in Example 2 unless otherwise indicated.

EXAMPLE 4

This Example demonstrates the particularly preferred embodiment of this invention. A conductor coating paste is prepared by blending 79 parts by weight of Glass A with 21 parts by weight of iron powder. The glass is a frit in which 100% of the frit particles pass a 270 mesh U.S. Sieve Series screen. The iron powder is available as K-291 from the Glidden Company. 85 parts by weight of the resulting solids component are blended with 15 parts by weight of a vehicle comprising 4 parts by weight KLUCEF EF in deionized water.

The conductor coating paste is brushed onto the funnel and neck portions of two 19 V 90° color television tubes to form the patterns shown in the FIGURE as 21 and 23. The paste is applied in an amount sufficient to yield an average fired film thickness of about 50 microns. The paste is then air dried.

A resistor coating paste is prepared by blending 78 parts by weight of Glass A, 16 parts by weight of iron and 6 parts by weight of $TiO_2$. The $TiO_2$ is designated by the trademark TITANOX 2005, which is a certified grade $TiO_2$ in which 99.99% passes a 325 U.S. Sieve Series screen. It is available from National Lead Company, Titanium Pigments Division, South Amboy, N.J. 08879. The glass and iron are the same as those employed in the conductor coating paste. 80 parts by weight of the resulting solids component are blended with 20 parts by weight of a vehicle comprising:

| | | Parts by Weight |
|---|---|---|
| Amyl Acetate | | 96.1 |
| Ethylene Glycol | | 2.4 |
| Nitrocellulose | (N-50) | 1.2 |
| KLUCEL EF | | 0.2 |
| Citric Acid | | 0.1 |

The nitrocellulose and KLUCEL EF are binders that give the paste green strength, while the amyl acetate and ethylene glycol act as solvents for the binders. The citric acid extends the shelf life of the paste by retarding the formation of gel during storage.

The resistor coating paste is brushed onto the neck and funnel portions of the two color television tubes containing the conductive pastes and as shown in the FIGURE as 22. The funnels were again air dried for 1 hour and then fired in a sealing lehr with the faceplate. The thickness of the resistor layer was about 50 microns after firing.

The resistance of the conductor coating in the two tubes ranged from 0.5K to 1.0K ohms and the resistance of the resistor coating ranged from 2.4 megohms to 2.7 megohms. Complete TV color picture tubes were assembled, and then each tube was baked and the interior evacuated by applying a vacuum. Each tube was then subjected to the standard operating tests (raster, color dot, beam divergence, etc.) and found to be acceptable. Each tube was tested for arcing by increasing the voltage of the tube to 40 KV. Current was measured by an oscilloscope with careful visual observation of the scope for signs of peak currents indicating the presence of arcing in the tube. Peak currents of 6.7 amps and 4.4 amps were observed, well within tolerable limits.

A barium getter provided in each tube during assembly was then flashed, and the same test procedure repeated. There was no substantial increase in the temperature of the tube during gettering indicating that the metal in the conductor and resistor coatings was not absorbing the RF energy being applied for flashing of the getter; therefore, the metal did not interfere with the flashing of the getter. When the test procedure was repeated, no peak currents were observed or measured. The tubes are considered to be arc-free in that no high current-generating internal arcing occurs.

EXAMPLE 5

Example 4 is repeated except that the resistor coating paste comprises 18% iron, 6% $TiO_2$ and 76% glass frit, and the vehicle comprises 1% nitrocellulose (N-50) and 99% amyl acetate. The resistor paste and conductor paste are each employed in an amount sufficient to yield fired resistor and conductor layers of about 25 microns (about 25 grams). Resistance values for the electrically resistive layer averaged 18 megohms and the peak current averaged 8.9 amperes.

EXAMPLE 6

Example 5 is repeated except that the vehicle is comprised of 1.5% nitrocellulose (N-50) in 98.5% amyl acetate. The average resistance of the electrically resistive layer is 14 megohms and the average peak current is 9.6 amperes.

EXAMPLE 7

Example 5 is repeated except that the vehicle for the resistor paste is the same vehicle as that in the resistor paste of Example 4. The average resistance of the electrically resistive layer is 22.5 megohms, and the average peak current is 6.4 amperes.

In the foregoing Example 5, the viscosities were measured at 23° C, using a Brookfield RVT Viscometer using a TA tee bar at 50 and 100 RPM. Each glass frit had a particle size such that 100% of glass frit particles passed a 100 mesh U.S. Sieve Series screen and 67 ± 5% of the frit particles passed a 400 mesh U.S. Sieve Series screen, unless otherwise indicated. Resistances were measured at 23° C. using a Hewlett-Packard Model 412 A DC vacuum tube voltmeter.

It will be understood that the binder utilized in the vehicle employed in practicing this invention can be any binder well known for its function of imparting green strength to the paste, i.e. to hold the frit together for a period of time sufficient to enable the paste to hold its shape both before and during the firing operation. The amount of binder necessary for the paste is that amount which will maintain the frit in a wet form and which holds its shape for the necessary length of time. The binder is pyrolyzable upon being subjected to heat below the temperature at which the frit is fired, leaving only a minor amount of residue in the fired frit. Nitrocellulose dissolved in amyl acetate is a well known binder for pastes containing glass frits. The amount of nitrocellulose in solution is usually about 1 to about 1.4% by weight.

In Examples 4, 5, 6 and 7 herein, the resistance values are not expressed as resistivities because of the difficulty in determining the interior surface area of the TV tube. Rather, resistance is expressed in ohms, and is measured as follows. The resistance of the electrically conductive layer is measured by placing one measuring probe at the periphery of the layer nearest the faceplate and the other measuring probe at the opposite periphery nearest the neck, and reading the resistance in ohms. The resistance of the electrically resistive layer is determined by removing the snubber assembly (shown as 28 in the FIGURE) from an electron gun, and inserting the snubber assembly in the neck of the tube so that the snubbers contact the electrically conductive layer in the neck. One of the measuring probes is connected to the snubber assembly and the other measuring probe is connected to the anode button. The resistance is then read in ohms.

When the electrically resistance composition of Example 4 was applied to glass panels as described in Example 2, the resistivity from bus bar to bus bar ranged from 1.6 megohms to 2.5 megohms. Similarly, when the electrically conductive composition of Example 4 was applied to glass panels as described in Example 2, the resistivity from bus bar to bus bar ranged from 0.4K to 1.2K ohms.

As used herein, the expression "consisting essentially of" is to be given its generally accepted meaning as requiring the presence of the recited ingredients, but not excluding the presence of unrecited ingredients that do not materially detract from the basis and novel characteristics of the composition as disclosed.

As used herein, the term "resistivity" means resistance per square. Resistance per square is defined in *The Encyclopedia of Electronics*, Reinhold Publishing Corp., New York (1962), page 721.

This invention is accompanied by a number of advantages. The cathode ray tube of this invention is capable of being operated at high voltages, such as test voltages up to about 40,000 volts, and operating voltages in electronic equipment up to about 35,000 volts without substantial internal arcing. The electrically conductive and electrically resistive compositions are capable of serving the same function as dag coatings heretofore used in cathode ray tubes, without the peeling and flaking problems previously described. The electrically resistive composition and electrically conductive composition of this invention are each capable of being fired to form layers that are resistant to abrasion and scratching. According to this invention, it is possible to manufacture cathode ray tubes by using the techniques commonly used in large scale manufacture without requiring substantial changes in these techniques. The compositions of this invention are capable of being bonded to the internal surfaces of cathode ray tubes during the firing cycles now employed, such as the firing cycle used during the sealing of the faceplate to the funnel portion of the tube. The physical and electrical properties of the compositions of this invention after firing exhibit the required stability when the tube is fired and re-fired during assembly of the various components of the tube. This invention makes it possible to produce cathode ray tubes for use in color television receivers wherein peak current at the anode button of the tubes is about 30 amperes or less, and even 10 amperes or less, during normal operation of the receiver.

What is claimed is:

1. An electrically conductive composition for use on interior surfaces of a funnel portion and neck portion of a cathode ray tube in order to substantially suppress internal arcing during operation of said tube, said composition consisting essentially of a substantially homogeneous mixture of:

a. about 10–30 percent by weight of iron having a particle size of about 0.1–20 microns; and b. about 90–70 percent by weight of a lead borate or lead zinc borate glass frit having a particle size such that about 100% of the glass frit particles pass a 100 mesh U.S. Sieve Series screen;

said composition being capable of being fired on said funnel and neck portions at a temperature of about 400°–450° C. to form layers each layer having a thickness of about 18–70 microns and an electrical resistivity of about 1 ohm to about 2000 ohms; said composition being capable of substantially suppressing arcing within said tube during operation of said tube at a voltage up to about 40,000 volts.

2. Composition according to claim 1 consisting essentially of:

a. about 20–25 percent by weight iron having a particle size of about 0.1 to 10 microns; and b. about 80–75 percent by weight of a lead zinc borate glass frit.

3. Composition according to claim 1 wherein said frit is a lead zinc borate glass frit comprising in weight percent PbO about 75 – 86
ZnO about 0 – 16
$B_2O_3$ about 8 – 15
$SiO_2$ about 0 – 5
BaO about 0 – 2
$SnO_2$ about 0 – 2.

4. Composition according to claim 1 consisting essentially of about 21 percent by weight iron, about 79 percent by weight glass frit having a particle size such that about 100% of glass frit particles pass a 100 mesh U.S. Sieve Series screen and about 67% ± 5% pass a 400 mesh U.S. Sieve Series screen, said glass frit consisting essentially of the following ingredients expressed in weight percent:

PbO about 75
ZnO about 12.6
$B_2O_3$ about 8.3
$SiO_2$ about 2.1
BaO about 2 wherein said resistivity is about 500 – 2000 ohms and said thickness is about 45 – 55 microns.

5. An electrically resistive composition for use on interior surfaces of a funnel and neck portion of a cathode ray tube in order to substantially suppress internal arcing during operation of said tube, said composition consisting essentially of a substantially homogeneous mixture of:

a. about 8 – 24 percent by weight of iron having a particle size of about 0.1–20 microns;

b. about 2 – 8 percent by weight of $TiO_2$ having a particle size of about 0.1–45 microns; and c. about 90 – 68 percent by weight of a lead borate or lead zinc borate glass frit having a particle size such that about 100% of glass frit particles pass a 100 mesh U.S. Sieve Series screen;

said composition being capable of being fired on said funnel and neck portions at a temperature of about 400°– 450° C to form a layer having a thickness of about 18 – 70 microns and an electrical resistivity of about 0.5 megohm to about 80 megohms; said composition being capable of substantially suppressing arcing within said tube during operation of said tube at a voltage up to about 40,000 volts.

6. Composition according to claim 5 consisting essentially of:

a. about 16 – 18 percent by weight iron;

b. about 5 – 6 percent by weight $TiO_2$; and c. about 79 – 76 percent by weight of a lead zinc borate glass frit.

7. Composition according to claim 5 wherein said frit is a lead zinc borate glass frit comprising in weight percent PbO about 75 – 86
ZnO about 0 – 16
$B_2O_3$ about 8 – 15

$SiO_2$ about 0 – 5
BaO about 0 – 2
$SnO_2$ about 0 – 2.

8. Composition according to claim 5 consisting essentially of about 16 percent by weight iron, about 6 percent by weight $TiO_2$ and about 78 percent by weight of a glass frit having a particle size such that about 100% of glass frit particles pass a 100 mesh U.S. Sieve Series screen and about 67 ± 5% pass a 400 mesh U.S. Sieve Series screen, said glass frit consisting essentially of the following ingredients expressed in weight percent:

PbO about 75
Zno about 12.6
$B_2O_3$ about 8.3
$SiO_2$ about 2.1
Bao about 2 wherein said resistivity is about 1 – 20 megohms and said thickness is about 45 – 55 microns.

* * * * *